US010450747B2

(12) United States Patent
Albartus et al.

(10) Patent No.: US 10,450,747 B2
(45) Date of Patent: Oct. 22, 2019

(54) SUPPORT SYSTEM AND SYSTEM OF CONNECTION ELEMENTS FOR CONNECTING SUPPORTS

(71) Applicant: HALFEN GmbH, Langenfeld (DE)

(72) Inventors: Dirk Albartus, Bochum (DE); Paulus Van De Schoor, Köln (DE); Ralf Armbrecht, Düsseldorf (DE); Jens Geffert, Hilden (DE); Sascha Haefke, Overath (DE); Regina Michalik, Solingen (DE)

(73) Assignee: HALFEN GMBH, Langenfeld (DE)

( * ) Notice: Subject to any disclaimer, the term of this patent is extended or adjusted under 35 U.S.C. 154(b) by 0 days.

(21) Appl. No.: 16/146,412

(22) Filed: Sep. 28, 2018

(65) Prior Publication Data

US 2019/0100914 A1 Apr. 4, 2019

(30) Foreign Application Priority Data

Sep. 29, 2017 (EP) ..... 17194089

(51) Int. Cl.

| | |
|---|---|
| ***E04B 9/14*** | (2006.01) |
| ***E04B 9/34*** | (2006.01) |
| ***E04B 9/10*** | (2006.01) |
| ***E04B 9/18*** | (2006.01) |
| ***E04B 9/12*** | (2006.01) |

(52) U.S. Cl.

CPC ..... *E04B 9/14* (2013.01); *E04B 9/10* (2013.01); *E04B 9/18* (2013.01); *E04B 9/345* (2013.01); *E04B 9/127* (2013.01)

(58) Field of Classification Search

CPC ..... E04B 9/10; E04B 9/12; E04B 9/14; E04B 9/18; E04B 9/345; E04B 9/127; E04B 9/064; E04B 9/065

See application file for complete search history.

(56) References Cited

U.S. PATENT DOCUMENTS 5,481,842 A * 1/1996 Gautreau ..... E04B 2/76 52/656.9
2004/0033103 A1* 2/2004 Ludwig ..... E04B 9/14 403/188

FOREIGN PATENT DOCUMENTS

DE 3020627 A1 * 12/1981 ..... E04B 9/14
DE 3443883 A1 6/1986

(Continued)

*Primary Examiner* — Christine T Cajilig
(74) *Attorney, Agent, or Firm* — Lucas & Mercanti, LLP; Klaus P. Stoffel

(57) ABSTRACT

A support system includes supports and connection elements for interconnecting the supports. The supports are interconnected by plug connections. The interacting plug connection components that form the plug connection include at least one plug element and at least one plug receptacle. Each connection element is established on a support and has at least one plug connection component. The support system has first connection elements, the at least one plug connection component of which is disposed on a longitudinal side of the assigned support. The support system has second connection elements, the at least one plug connection component of which are disposed on an end side of the assigned support, and the second connection elements are selectively connectable to a first connection element or to a further second connection element. A system of connection elements includes first connection elements as well as second connection elements.

16 Claims, 6 Drawing Sheets

(56) References Cited

FOREIGN PATENT DOCUMENTS

| | | | | | |
|---|---|---|---|---|---|
| DE | 202006002567 | U1 | | 4/2006 | |
| DE | 102006027804 | B3 | | 11/2007 | |
| EP | 1561875 | A1 | * | 8/2005 | ..... E04B 9/064 |

* cited by examiner

SUPPORT SYSTEM AND SYSTEM OF CONNECTION ELEMENTS FOR CONNECTING SUPPORTS

CROSS-REFERENCE TO RELATED APPLICATIONS

The present application claims priority of EP 17 194 089.3, filed Sep. 29, 2017, the priority of this application is hereby claimed and this application is incorporated herein by reference.

BACKGROUND OF THE INVENTION

The invention relates to a support system and to a system of connection elements for connecting supports.

Support systems from supports and the connection elements connecting the supports are used, for example, for so-called grid element ceilings, thus suspended interior ceilings. Grid element ceilings of this type are used, for example, in order to install temporary attachment points for the technical event equipment and supply lines such as, for example power lines, to desired locations in exhibition halls, and/or for achieving fastening possibilities for add-on parts at desired positions on the suspended interior ceiling.

A suspended, non-supporting interior ceiling made from longitudinal supports and transverse supports that connect the longitudinal supports is known from DE 20 2006 002 567 U1. The longitudinal supports and transverse supports are configured as extruded profiles. Receptacle grooves for lateral adapters are provided in the longitudinal supports. A transverse support by way of an end plate that is disposed on the end side of the transverse support can be hooked into the lateral adapters. A connection profile which protrudes into the cavities of the longitudinal supports to be interconnected is provided for interconnecting longitudinal supports.

SUMMARY OF THE INVENTION

The invention is based on the object of achieving a support system of the generic type which is of a simple construction and enables a rapid and flexible assembly of the support system.

A further object of the invention lies in achieving a system of connection elements for connecting supports which is of simple construction and enables a simple and rapid interconnection of the supports.

It is provided that the supports are interconnected by way of plug connections. It is provided that each connection element has at least one plug connection component of a plug connection. The support system has first connection elements, the at least one plug connection component of the latter being disposed on a longitudinal side of the assigned support. In order to achieve a simple and modular construction of the support system, it is provided that the support system comprises second connection elements, the at least one plug connection component of the latter being disposed on an end side of the assigned support. The second connection elements herein are designed such that said second connection elements are selectively connectable to a first connection element or to a further second connection element. On account thereof, a support which on an end side supports a second connection element can be selectively installed thereon as a transverse support and to this end be connected to a first connection element of an existing longitudinal support, or alternatively be used as a longitudinal support and to this end be connected to a second connection element that is disposed on the end side of a further longitudinal support. A simple construction of the support system is achieved on account thereof. The number of different types of connection elements required is reduced, since longitudinal supports as well as transverse supports can be connected to existing longitudinal supports by way of second connection elements. On account thereof, warehousing and logistics are also simplified. Transverse supports and longitudinal supports can be embodied having identical dimensions and in particular also having the same construction in terms of the cross section. Production and warehousing are simplified on account thereof. A positive external appeal of the support system results, since longitudinal supports and transverse supports cannot be visually distinguished in the case of assembled support systems.

On account of the supports being interconnected by way of plug connections, simple and rapid assembling and disassembling of the support system is enabled. No screw connections are preferably to be fixed or released in order for the supports to be connected. A plug connection enables a force-fitting connection between the supports and can also transmit transverse forces and torques between the supports. On account thereof, a simple and solid connection between the supports is achieved. The plug connections can be disposed in a space-saving manner. Plug connections enable a largely invisible connection of the supports such that a positive appearance of the support system results on account of the use of plug connections.

In a preferred design embodiment, all supports at the end sides thereof are provided with second connection elements. Each second connection elements preferably has a plug element as well as a plug receptacle of the plug connection. On account thereof, only a single embodiment of second connection elements is required. The plug receptacle and the plug element in the installed position are preferably disposed above one another. In the case of longitudinal supports that run in the longitudinal direction, the plug element and the plug receptacle on the two end sides of the longitudinal support are preferably dissimilarly oriented. On one end side, the plug element is disposed in the upper region and the plug receptacle is disposed in the lower region of the connection element, and on the other end side the plug receptacle is disposed in the upper region and the plug element is disposed in the lower region of the connection element. This can be achieved in a simple manner by assembling the second connection element in an orientation that is rotated by 180° about the longitudinal axis of the support. On account thereof, a further longitudinal support can always be assembled in the same direction, preferably from above, on an already assembled longitudinal support. In the case of transverse supports, a second connection element is preferably disposed on both end sides in the same orientation, preferably having the plug receptacle in the lower region and the plug element in the upper region. On account thereof, transverse supports can be assembled simultaneously in the same orientation, thus in particular from above, on both end sides in adjacent longitudinal supports.

The designations "top/upper", "bottom/lower", "horizontal" and "vertical" as well as all further terms referring to the spatial position which are presently used relate in each case to the installed position of the support system in which the support system is disposed on a support structure.

The plug receptacles are preferably oriented in the vertical direction so as to enable an assembly from above. However, in an alternative design embodiment it can also be provided that the plug receptacles run laterally in relation to the longitudinal direction of the support and a support, on account thereof, is to be assembled on an existing support in the lateral direction, for example by inward pivoting or lateral displacement.

Each connection element advantageously has at least one plug element and at least one plug receptacle. On account thereof, each connection element can form each plug connection component of a plug connection, specifically a plug receptacle or a plug element. In a particularly preferable design embodiment, in the case of two interconnected connection elements each plug element is disposed in an assigned plug receptacle. On account thereof, a high strength of the plug connection is achieved, and the mutual orientation of the supports can simultaneously be established by way of the two plug elements that in the connection plan are mutually spaced apart. On account thereof, comparatively high torques about the longitudinal axis of a support can also be absorbed. However, it can also be provided that each connection element does indeed in each case have a plug element and a plug receptacle, however in the case of each plug connection either the plug element or the plug receptacle is alternatively on an assigned plug connection component of the other connection element.

In one particularly preferred design embodiment the plug element is formed by a screw. An element that engages behind the plug receptacle can be provided in a simple manner by way of a screw. The mutual relative position of the supports can be varied by varying the screw-in-depth of the screw. On account thereof, existing positional tolerances between the supports can be equalized in a simple manner.

In a particularly preferred design embodiment the plug receptacle is configured as a clearance. A simple construction results on account thereof.

In order to avoid that the plug connection is released when forces counter to the assembly direction arise, at least one plug-fittable securing element which secures the plug connection against unintentional releasing is advantageously provided. On account of the securing element being plug-fittable, no screw connection is required for securing the plug connection such that a simple and rapid assembly and disassembly results. Should the plug receptacles in the installed position be oriented in the vertical direction, the securing element in the preferred design embodiment is a safety split pin. In the case of a horizontally oriented plug receptacle, the securing element can be, for example, a U-shaped disk or the like which is to be pushed in from above.

The support system advantageously comprises at least one suspension element which is separate from the connection elements and which is provided for connecting a support to a support structure. The suspension element can be fixed to the ceiling of the room in a known manner by way of the threaded bars. On account of the suspension element being configured separately from the connection elements, the position of one or a plurality of suspension points can be chosen independently of the position of the transverse supports. It is advantageously provided that at least one connection element per se is provided for connecting a support to a support structure. On account thereof, the number of required parts for the interconnection of the supports and for the connection of the latter to the support structure can be reduced. A connection element which is provided for connecting a support to the support structure and simultaneously serves for interconnecting two supports is particularly advantageous when the linking points on the support structure coincide with the connection points of longitudinal supports and transverse supports.

A simple construction results when at least one connection element has a connection bracket which encompasses the assigned support. In a particularly advantageous design embodiment the connection bracket is configured so as to be closed and completely encompasses the support. However, a partially open shape of a connection bracket can also be advantageous, in particular a shape that is opened toward the bottom. On account thereof, an assembly rail that runs on the lower side of a support can also remain accessible in the region of the connection bracket.

In a preferred design embodiment the connection bracket is formed by two individual parts that are interconnected on the upper side and the lower side of the support. The two individual parts herein are preferably C-shaped. On account of the individual parts being interconnected on the upper side and the lower side of the support, no connection elements are required on the longitudinal side of the support such that a positive external appeal of the support system results. The individual parts are preferably interconnected by way of at least one releasable connection installation. On account thereof, a connection bracket can also be retro-fitted to a longitudinal support that is already assembled on a support structure. Simultaneously, the plug connection between a longitudinal support and a transverse support is not compromised by the connection installation which interconnects the individual parts of the connection bracket. The two individual parts in a preferred design embodiment are configured so as to be C-shaped and mutually engage so as to be adjacent to the upper side and the lower side of a support.

In a particularly preferred design embodiment the individual parts are interconnected by way of at least one connection installation which simultaneously fixes the connection element to the support. On account thereof, the number of individual parts required for the support system can be reduced. The connection installation preferably comprises a connection element which protrudes through openings of both individual parts such that the individual parts are interconnected even in the event of a partially released connection installation and the connection element cannot be released from the support. The connection element can be, for example, a hammer-head bolt. In an advantageous design embodiment the individual parts are interconnected by way of at least one connection installation which simultaneously serves for connecting the connection element to the support structure. On account thereof, no additional elements are required for the connection to the support structure. In a preferred design embodiment, the individual parts on the lower side thereof are interconnected by way of a connection installation which simultaneously fixes the connection element to the support. Alternatively, a connection installation which fixes the connection element to the support, or a connection installation which serves for connecting the connection element to the support structure, can be provided on the upper side of the support.

At least one connection element, in particular a second connection element, preferably has at least one lug for plug-fitting into a support at the end side. On account thereof, the connection element can be assembled in a simple manner on the end side on a support.

At least one connection element is preferably configured largely as a bent sheet-metal part. In a particularly preferred design embodiment all connection elements are configured largely as bent sheet-metal parts. Only the plug elements, preferably screws, and elements of the connection installation are preferably disposed on the bent sheet-metal parts.

In a preferred design embodiment it is provided that each plug connection in the installed position is to be assembled from above and produces a fixed connection in all horizontal directions and a downward fixed connection. On account of the plug connection in the installed position having to be assembled from above and producing a fixed connection in all horizontal directions in downward manner, the plug connection can be assembled by one person. The two supports are fixedly interconnected after the plug connection has been produced. The securing element that is optionally to be additionally assembled serves only for securing the connection. On account of no screw connections having to be produced, a very short assembly time is achieved.

For a system of connection elements for connecting supports by means of plug connections, wherein each connection element has at least one plug connection component of a plug connection, wherein the interacting plug connection components that form the plug connection comprise at least one plug element and at least one plug receptacle, it is provided that the first connection elements have a receptacle for passing through a support, wherein the at least one plug connection component of the first connection elements is disposed laterally to the longitudinal direction of the receptacle. The system moreover comprises second connection elements which have at least one lug for fastening the connection element to the end side of a support. The second connection elements have at least one plug connection component which is disposed on that side of the connection element that faces away from the lug. The second connection elements are designed such that said second connection elements are selectively connectable to a first connection element or to a further second connection element.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
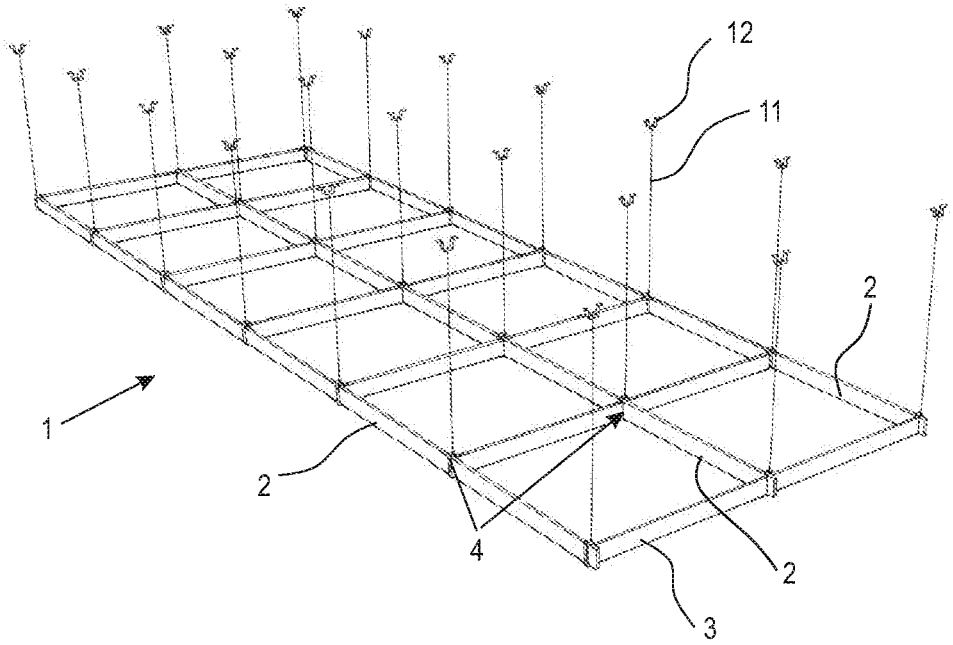
FIG. 1 shows a perspective illustration of a first exemplary embodiment of a support system.

FIG. 1 in a perspective illustration shows an exemplary embodiment of a support system, specifically a grid element ceiling 1. The grid element ceiling 1 is constructed from longitudinal supports 2 which run so as to be mutually parallel. The longitudinal supports 2 are to be connected to a support structure, for example a ceiling of a hall, by way of connection elements, in the exemplary embodiment threaded bars 11. The longitudinal supports 2 are interconnected by way of transverse supports 3 which in the exemplary embodiment run orthogonally in relation to the longitudinal supports 2. The longitudinal supports 2 and transverse supports 3 define a lattice-shaped grid. Holding parts 12 which can be screw-fitted to the support structure are provided on that upper end of the threaded bars 11 that faces away from the grid element ceiling 1 in the exemplary embodiment, in order for the threaded bars 11 to be connected to a support structure. The threaded bars 11 are adjustable in relation to the holding parts 12 as well as in relation to the grid element ceiling 1, such that the grid element ceiling 1 is adjustable in terms of the height thereof.

Figure 2:
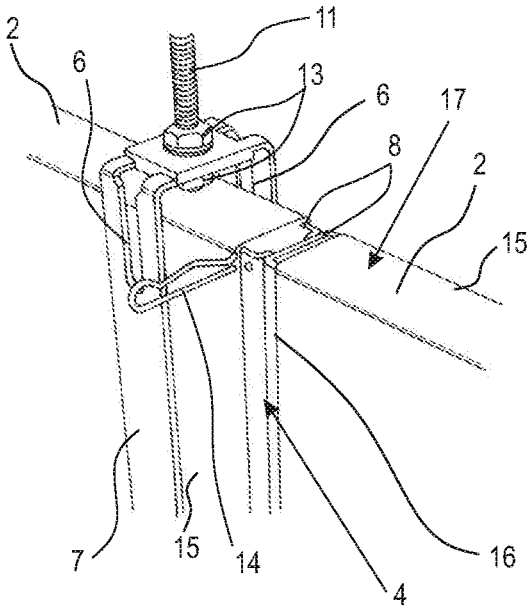
FIG. 2 shows a perspective enlarged illustration of a region of a connection between two longitudinal supports of the support system from FIG. 1.
Figure 3:
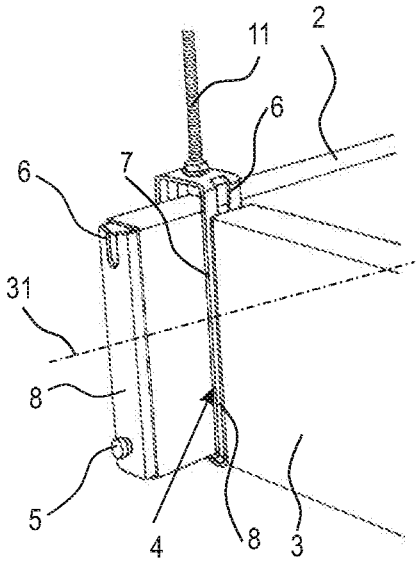
FIG. 3 shows an enlarged perspective illustration of the region of the connection of a transverse support to a longitudinal support of the support system from FIG. 1.

The longitudinal supports 2 and transverse supports 3 are interconnected by way of plug connections 4. FIG. 2 shows a plug connection 4 between two longitudinal supports 2 in an enlarged illustration. Each longitudinal support 2 on the end side 16 thereof that lies transversely in relation to a longitudinal central axis 31 (FIG. 3) of the longitudinal support 2 supports a connection element 8. As is shown in FIG. 3, the connection elements 8 have in each case one plug element 5 and one plug receptacle 6. The plug receptacle 6 in the exemplary embodiment is oriented in the vertical direction and on that side thereof that faces away from the plug element 5 has an access opening. FIG. 3 shows the longitudinal support 2 (illustrated on the left in FIG. 2) assembled on a support structure. The longitudinal support 2 (illustrated on the right in FIG. 2) can be fixed to said longitudinal support 2 when the second connection element 8 is assembled on the longitudinal support 2 (illustrated on the right in FIG. 2) in a reversed manner, thus rotated in relation to the second connection element 8 of the left longitudinal support 2 by 180° about the longitudinal central axis 31 of the longitudinal support 2.

In order to prevent the plug connection 4 from being unintentionally released, for example on account of an upward loading on the longitudinal support 2 (illustrated on the right in FIG. 2), a safety split pin 14 which is plug-fitted transversely through a connection element 8 in the region of the insertion opening of the plug receptacle 6 is provided. It is prevented on account thereof that a plug element 5 that is disposed in the plug receptacle 6 can exit the plug receptacle 6.

Moreover, a first connection element 7 which serves for connecting to a support structure as well as for linking transverse supports 3 (FIG. 1) is shown in FIG. 2. As is shown in FIG. 2, the threaded bar 11 protrudes through the upper side of the first connection element 7. The upper side of the connection element 7 is that side that is disposed so as to be adjacent to an upper side 17 of the longitudinal support 2. The upper side 17 herein is that side of the longitudinal support 2 that in the installed position is disposed at the top. Nuts 13 for fixing the connection element 7 to the threaded bar 11 are screw-fitted onto the threaded bar 11 above and below the connection element 7. The vertical position of the connection element 7 in relation to the threaded bar 11 can be varied by rotating the nuts 13. As is also shown in FIG. 2, the first connection element 7 likewise has plug receptacles 6 which are in each case disposed on a longitudinal side 15 of the longitudinal support 2. Transverse supports 3 can be plug-fitted in the plug receptacles 6 of the first connection element 7 by way of the second connection elements 8 that are disposed on the end sides of said transverse supports 3, as is shown in FIG. 3. The second connection elements 8 are connection elements which serve for connecting longitudinal supports 2 to one another or for connecting to a first connection element 7 of a longitudinal support 2. As is also shown in FIG. 2, the threaded bars 11 are fixed to the connection elements 7.

Figure 4:
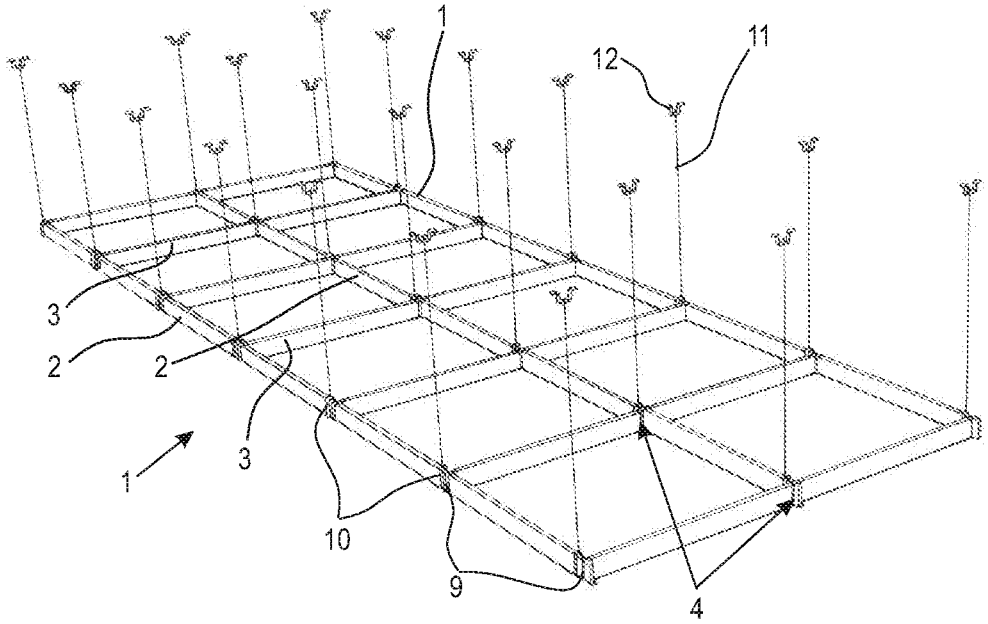
FIG. 4 shows a perspective illustration of an exemplary embodiment of a support system according to the invention.
Figure 5:
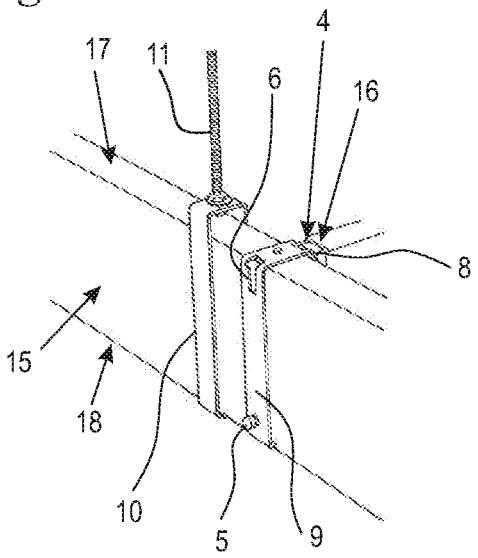
FIG. 5 shows a perspective enlarged illustration of the region of a connection between a longitudinal support and a transverse support of the support system from FIG. 4.
Figure 6:
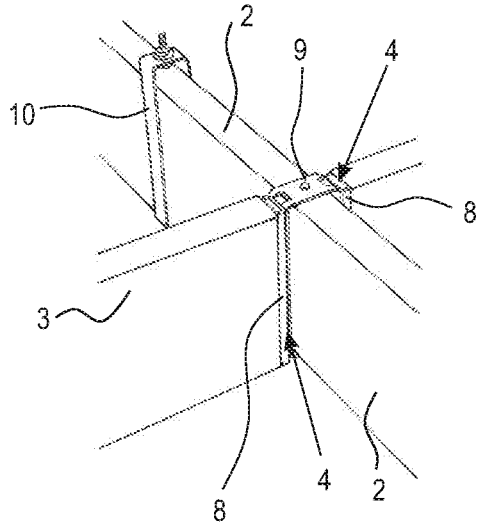
FIG. 6 shows an enlarged perspective illustration of the connection of two transverse supports to a longitudinal support of the support system from FIG. 4.

FIG. 4 shows an exemplary embodiment of a grid element ceiling 1 made from longitudinal supports 2 which are connected by way of the transverse supports 3. Plug connections 4 for connecting the transverse supports 3 to the longitudinal supports 2 are also provided here. However, the transverse supports 3 are fixed to connection elements 9 which do not have any link for threaded bars 11. This is shown in FIGS. 5 and 6. Instead, separate suspension elements 10 to which the threaded bars 11 are fixed are provided in the case of the embodiment as per FIGS. 4 to 6. The transverse support 3 on the end side 16 thereof has a second connection element 8 for connecting to the first connection element 9. The connection elements 9 and 8 by way of the plug receptacles 6 and plug elements 5 thereof form the plug connection 4. In the connected state, each plug element 5 is disposed in an assigned plug receptacle 6 of the respective other connection element 8, 9.

Both the connection elements 7 and 9 as well as the suspension elements 10 are configured so as to be bracket-shaped and completely encompass the respective longitudinal support 2. As is shown in FIG. 5, the connection elements 9 are also first connection elements in which the plug element 5 and the plug receptacle 6 are disposed on a longitudinal side 15 of the assigned longitudinal support 2.

FIGS. 7 to 11 show a transverse support 3 in detail. The transverse support 3 has an upper side 17, an opposite lower side 18 which in the installed state points downward, and two end sides 16. The transverse support 3 in the exemplary embodiment is configured so as to be cuboid. The end sides 16 are the smallest sides of the cuboid, and the longitudinal sides 15 (FIG. 8) are the largest sides of the cuboid.

Figure 7:
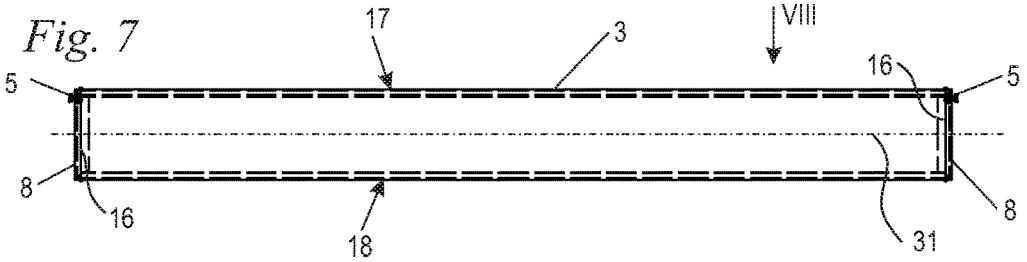
FIG. 7 shows a lateral view of a transverse support.

As is shown in FIG. 7, a second connection element 8 is disposed on each end side 16. The plug elements 5 in the exemplary embodiment are disposed on both end sides 16, so as to be adjacent to the upper side 17 of the transverse support 3. It is preferably provided for the longitudinal support 2 that the plug element 5 on one end side 16 is disposed so as to be adjacent to the upper side 17, and on the other, opposite end side 16, the plug element 5 is disposed so as to be adjacent to the lower side 18. A longitudinal support 2 is preferably assembled on a support structure such that the plug element 5 on that end side 16 on which a further longitudinal support 2 is to be assembled, is disposed so as to be adjacent to the lower side 18. On account thereof, the subsequent longitudinal support 2 can be plug-fitted to the existing longitudinal support 2 by way of the end side 16 on which the plug element 5 is disposed so as to be adjacent to the upper side 17.

Figure 8:
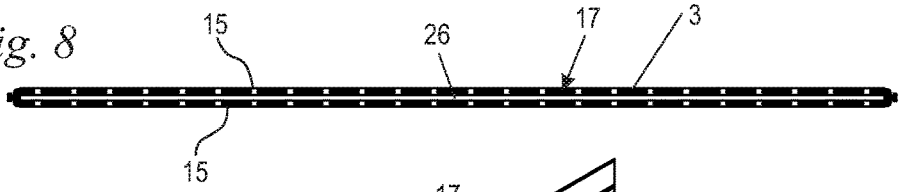
FIG. 8 shows a view from above in the direction of the arrow VIII in FIG. 7 onto the transverse support from FIG. 7.
Figure 9:
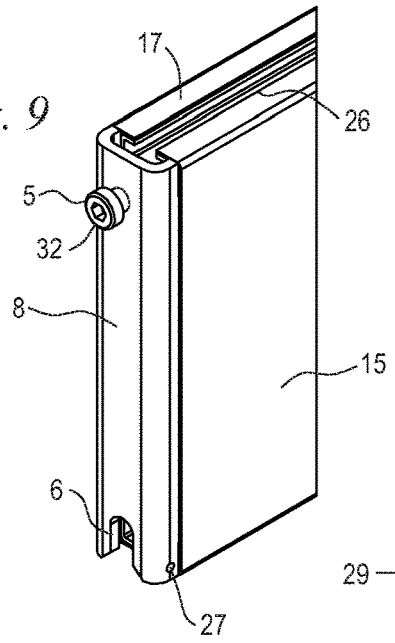
FIG. 9 shows an enlarged perspective illustration of the region of an end side of the transverse support from FIGS. 8 and 9, having a second connection element disposed thereon.

FIG. 8 shows a view onto the upper side 17 of the transverse support 3. As is shown in FIG. 8, a longitudinal slot 26 on the upper side 17 runs across the entire length of the transverse support 3 between the connection elements 8. The longitudinal slot 26 is also shown in FIG. 9. As is also shown in FIG. 9, the plug element 5 is formed by a screw that is screw-fitted into a bent sheet-metal part of the connection element 8. The head 32 of the screw, in the connection to a plug receptacle 6, engages behind the walls that the limit the plug receptacle 6 and thus produces a force-fitting connection between two adjacent second connection elements 8, or a connection to a connection element 7 or 9, respectively. As is also shown in FIG. 9, the second connection element 8, in a manner adjacent to the plug receptacle 6, has an opening 27 for the safety split pin 14 (FIG. 2). As is shown in FIG. 11, two mutually opposite openings 27 are provided such that the safety split pin 14 can be completely plug-fitted through the second connection element 8.

Figure 10:
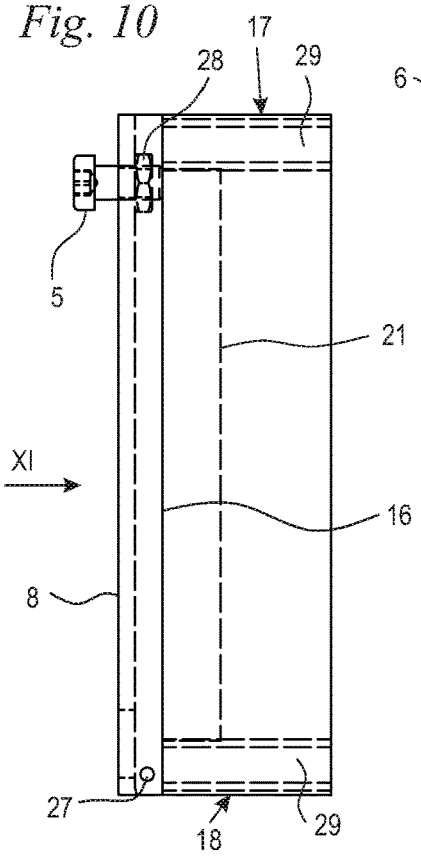
FIG. 10 shows a lateral view of the region of the transverse support shown in FIG. 9.
Figure 11:
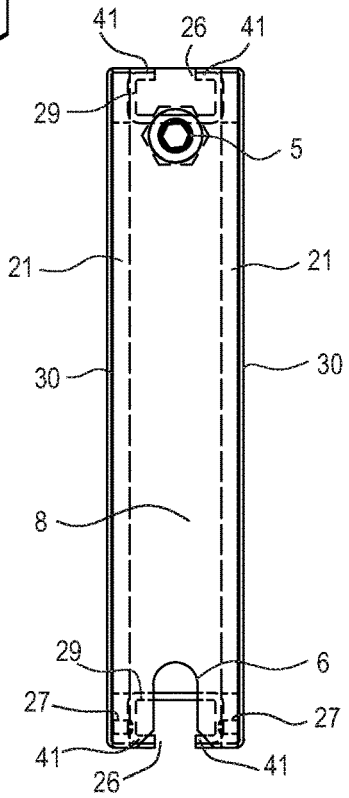
FIG. 11 shows a lateral view in the direction of the arrow VIII in FIG. 10 of the region of the transverse support shown in FIG. 10, having a connection element disposed thereon.

As is shown in FIGS. 9 to 11, the transverse support 3 is constructed from two assembly rails 29 which run on the upper side 17 and on the lower side 18. The assembly rails 29 form in each case the longitudinal slot 26. The longitudinal slot 26 is delimited by rail lips 41 of the assembly rails 29 that protrude toward one another. The two assembly rails 29 are connected by way of side walls 30 (FIG. 11) which form the longitudinal sides 15 of the transverse support 3. In each case one second connection element 8 is plug-fitted to the end side 16 of the transverse support 3. To this end, the connection element 8 has two lugs 21 which extend between the rear sides of the two assembly rails 26 of the transverse support 3.

As is shown in FIGS. 9 to 11, the second connection element 8 is configured as a U-shaped bent sheet-metal part.

The base of the U runs parallel with the end side 16 of the transverse support 3 and has the plug receptacle 6. Moreover, the screw that forms the plug element 5 and which in the exemplary embodiment is screw-fitted into a nut 28 that is held on the bent sheet-metal part is moreover disposed on the base. An adjustment of the transverse support 3 in relation to a longitudinal support 2, or an adjustment of two interconnected longitudinal supports 2 is possible by varying the screw-fitting depth of the plug element 5.

The assembly rails 29 serves for fixing the first connection elements 7, 9 and suspension elements 10 to the transverse support 3, as well as for fixing add-on parts to the transverse supports 3 or longitudinal supports 2, respectively. The longitudinal supports 2, with the exception of the arrangement of one of the two connection elements 8, are constructed in a manner identical to that of the transverse supports 3.

Figure 12:
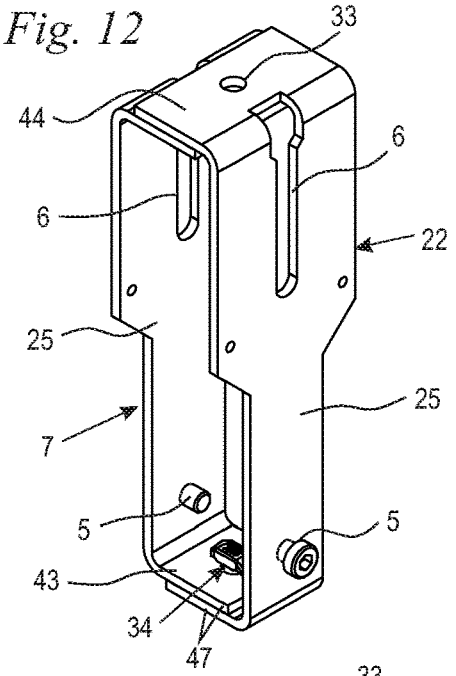
FIG. 12 shows a perspective illustration of a first connection element.
Figure 13:
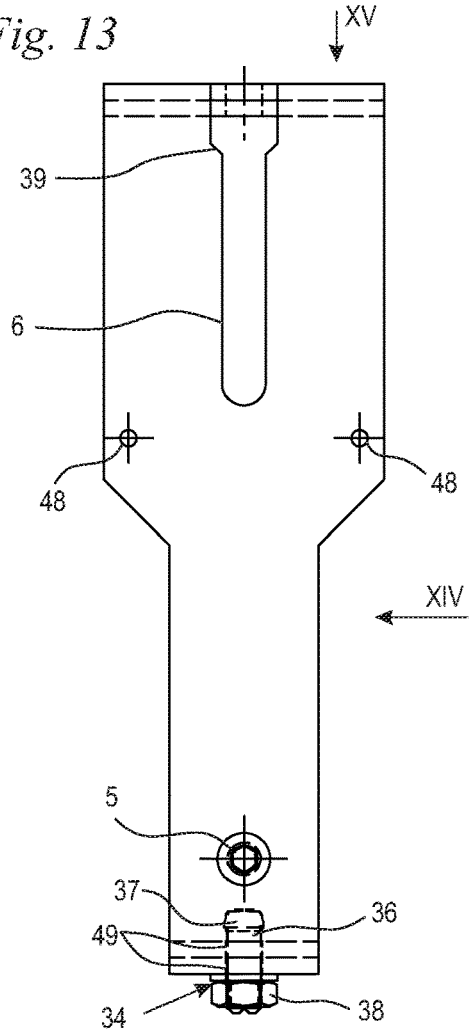
FIG. 13 shows a lateral view of the connection element from FIG. 12.
Figure 14:
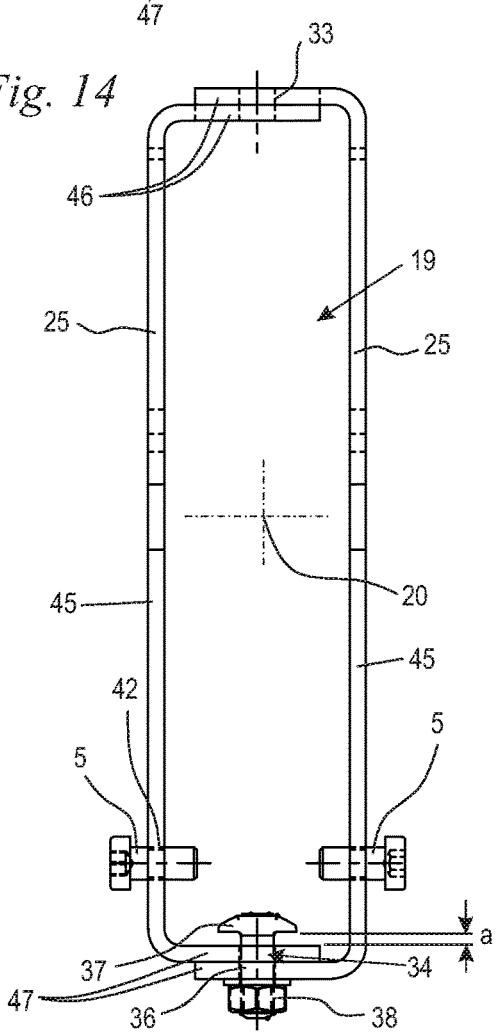
FIG. 14 shows a lateral view in the direction of the arrow XIV in FIG. 13 of the connection element from FIGS. 12 and 13.

FIGS. 12 to 15 show a first connection element 7 in detail. As is shown in FIG. 12, the connection element 7 is constructed from a connection bracket 22 into which the plug elements 5 are screw-fitted. Moreover, a connection installation 34 is disposed on the base 43 of the connection bracket 22. The connection bracket 22 has in each case two mutually opposite plug receptacles 6 and plug elements 5. An opening 33 which serves for receiving the threaded bar 11 or another holding element for connecting to a support structure is provided on the upper side 44 of the connection bracket 22 that is opposite the base 43. As is shown in FIGS. 12 and 14, the connection bracket 22 is formed by two individual parts 25 which are both designed so as to be approximately C-shaped and have a central part 45 that runs parallel with the longitudinal side 15 (FIG. 8) and end portions 46, 47 that run parallel with the upper side 17 and the lower side 18 (FIG. 7). The end portions 46 and 47 of the two individual parts 25 in each case bear on one another. One of the individual parts 25 preferably encompasses the other individual part 25 such that the two individual parts 25 are fixed in a preliminary manner even in the event of a released connection installation 34.

As is shown in FIG. 13, an introduction ramp 39 which facilitates the plug-fitting of the plug element 5 into the plug receptacle 6 is provided on the plug receptacle 6. The connection bracket 22 is embodied so as to be widened in the region of the plug receptacle 6. Two lateral bores 48 are disposed in the widened region. The first connection element 7 can be fixed to a longitudinal support 2 by way of the lateral bores 48, for example by way of self-tapping screws. A torsionally rigid mounting for a transverse support 3 that is hooked into the connection element 7 is achieved on account thereof. Any twisting of the transverse support 3 about the longitudinal central axis 31 thereof is prevented by this additional fixing of the connection element 7 to the longitudinal support 2.

Figure 15:
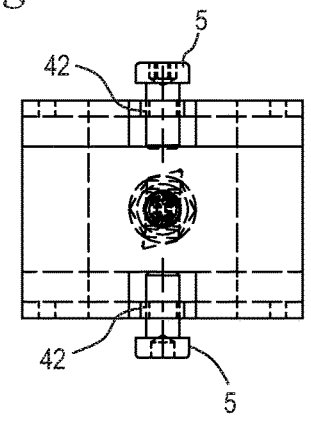
FIG. 15 shows a plan view in the direction of the arrow XV in FIG. 13 of the connection element from FIGS. 12 to 14.
Figure 16:
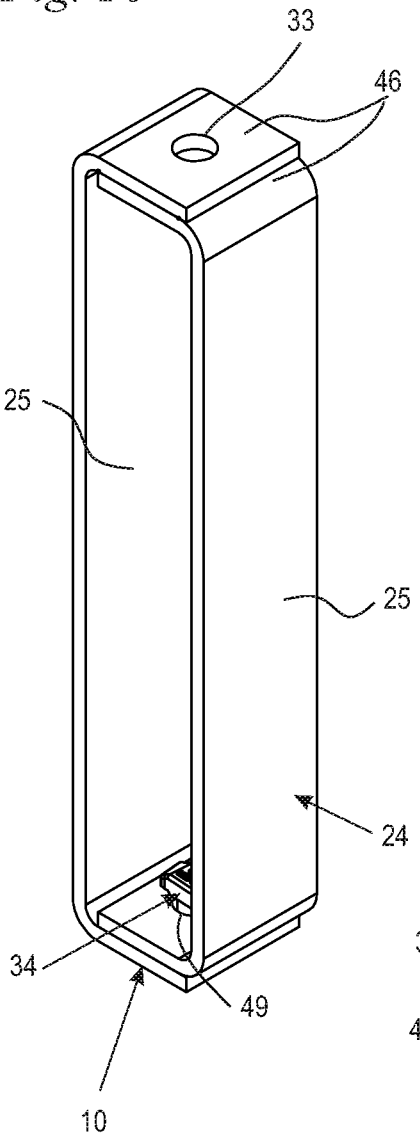
FIG. 16 shows a perspective illustration of a suspension element.
Figure 17:
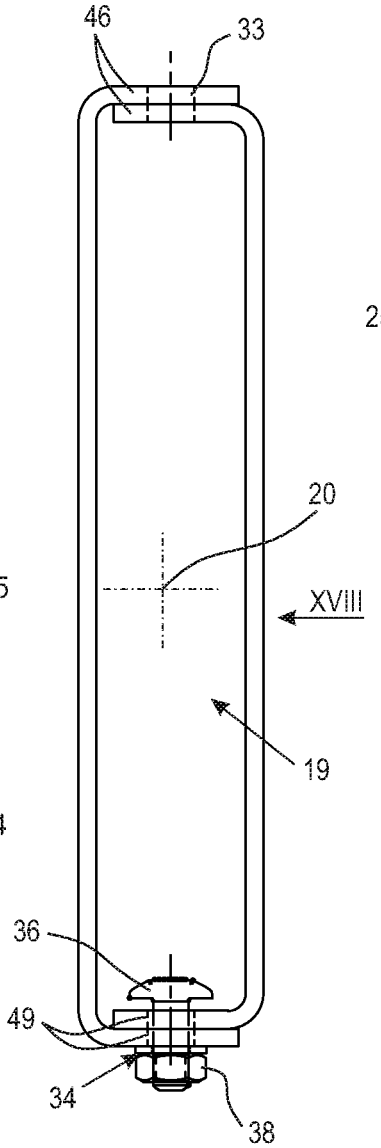
FIG. 17 shows a lateral view of the suspension element from FIG. 16.
Figure 18:
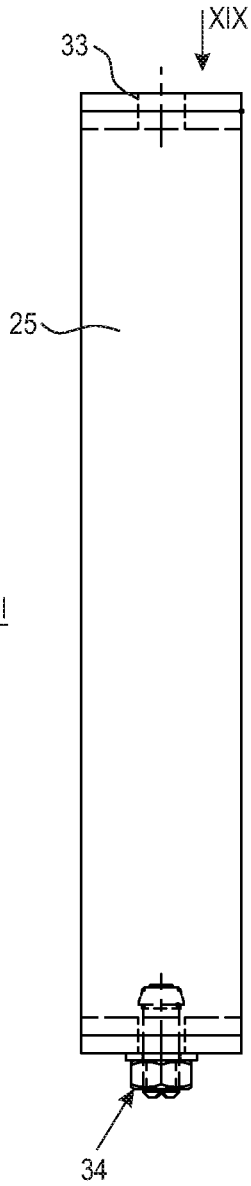
FIG. 18 shows a lateral view in the direction of the arrow XVIII in FIG. 17 of the suspension element from FIGS. 16 and 17.
Figure 19:
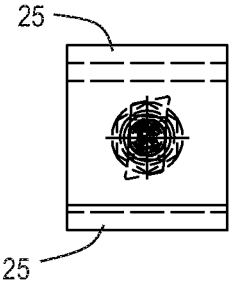
FIG. 19 shows a plan view in the direction of the arrow XIX in FIG. 18 of the suspension element from FIGS. 16 to 18.

The connection installation 34, as is shown in FIG. 13, has a screw 36 which in the exemplary embodiment is configured as a hammer-head bolt, and a nut 38 that is screw-fitted onto the screw 36. The screw 36 protrudes through bores 49 of the two end portions 47 of the individual parts 25. The hammer head 37, by rotating the screw 36 by 90° about the longitudinal central axis thereof, can be disposed such that said hammer head 37 engages behind the slot 35. The connection installation 34 can be fixed by tightening the nut 38. As is shown in FIGS. 13 and 14, a spacing a is formed between the hammer head 37 and the connection bracket 22. The spacing a corresponds approximately to the thickness of the rail lips 41 (FIG. 11) of the assembly rails 29. The screw 36 not only serves for mutually fixing the two individual parts 25 but also for establishing the first connection element 7 on a longitudinal support 2 or a transverse support 3. To this end, the connection element 7 is positioned at the desired location of the longitudinal support 2 or of the transverse support 3, the hammer head 37 is introduced through the longitudinal slot 26 into the assembly rails 29 and fixed by being rotated in the assembly rail 29, and the nut 38 is subsequently fixed on the screw 36. As is shown in FIGS. 14 and 15, the plug elements 5 are screw-fitted into threaded bores 42 of the individual parts 25. On account thereof, no additional nut for the plug elements 5 can be dispensed with. Instead of the nut 28 (FIG. 10) in the connection element 8 per se, a threaded bore can also be provided for the plug element 5 in the case of the second connection element 8.

As is shown in FIG. 14, the connection element 7 has a receptacle 19 in which a longitudinal support 2 or a transverse support 3 can be disposed. The longitudinal central axis 31 of the support 2, 3 in this instance is disposed so as to be parallel with the longitudinal direction 20 of the receptacle 19. In the event of the supports 2, 3 being disposed in the receptacle 19, the plug element 5 and the plug receptacle 6 are disposed on a longitudinal side 15 of the support 2, 3.

FIGS. 16 to 19 show a suspension element 10. The suspension element 10 has a connection bracket 24 which is constructed from two individual parts 25. The suspension element 10 does not have any plug elements 5 or plug receptacles 6, but only an opening 33 for receiving a threaded bar 11. The opening 33 protrudes through the end portions 46 of the individual parts 25 and in the installed state is disposed so as to be adjacent to the upper side 17 of a longitudinal support 2 or a transverse support 3 (cf. FIG. 7). The connection installation 34 is provided so as to be adjacent to the lower side 18 of a longitudinal support 2 or a transverse support 3, said connection installation 34 simultaneously serving for fixing the suspension element 10 to the longitudinal support 2 or the transverse support 3. The screw 36 protrudes through bores 49 of both individual parts 25. The suspension element 10 moreover has a receptacle 19 in which the longitudinal support 2 or the transverse support 3 can be disposed. The longitudinal central axis 31 of the support 2, 3 in this instance is disposed so as to be parallel, in particular congruent, with the longitudinal direction 20 of the receptacle 19.

Figure 20:
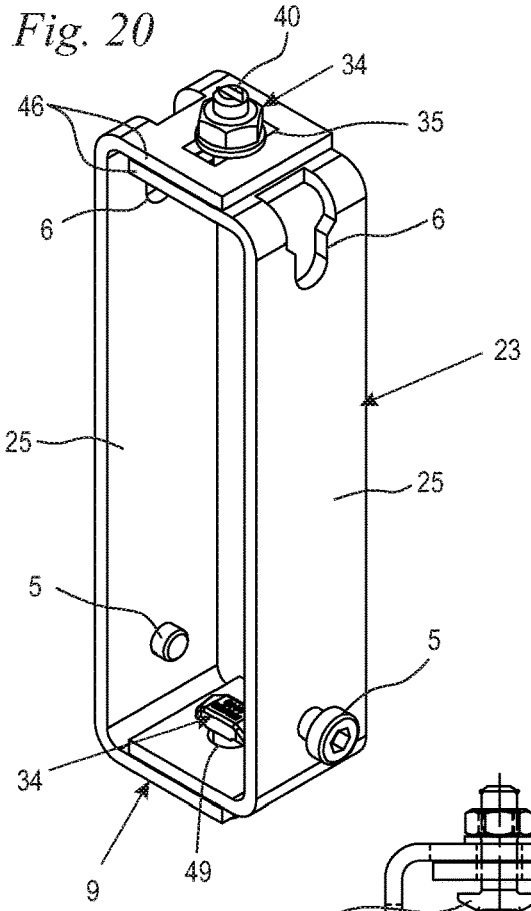
FIG. 20 shows a perspective illustration of an exemplary embodiment of a first connection element.
Figure 23:
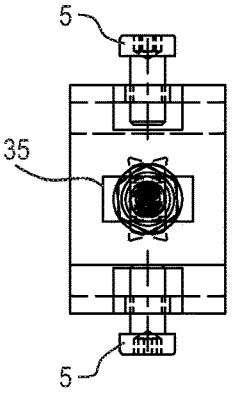
FIG. 23 shows a plan view in the direction of the arrow XXIII in FIG. 21 of the connection element from FIGS. 20 to 22.

FIGS. 20 to 23 show a first connection element 9. As is shown in FIG. 20, the first connection element 9 is formed by a connection bracket 23 which is constructed from two individual parts 25. The first connection element 9 differs from the first connection element 7 shown in FIGS. 12 to 15 in that the first connection element 9 does not have any opening 33 for connecting to a threaded bar 11. Instead, a connection installation 34 having a screw 36 is provided in that region that in the installed state is disposed so as to be adjacent to an upper side 17 (FIG. 7) of a longitudinal support 2 or transverse support 3, thus on the end portions 46 of the individual parts 25. The connection installations 34 on the upper side 17 and the lower side 18 of the support 2, 3 are preferably configured in an identical manner. As is shown in FIGS. 20 and 23, the individual parts 25 on the connection installation 34 on the end portions 46 have a slot 35 through which a hammer head 37 (FIGS. 13 and 14) of the screw 36 is pushed. On account thereof, the screw 36 can be assembled from the outside through the slot 35 on the connection element 9. By contrast, bores 48 through which the screw 36 is to be assembled from the inside are provided on the end portions 47. The slot 35 in an alternative design embodiments can be provided on the end portions 47, or on the end portions 46 as well as on the end portions 47.

In alternative design embodiments, the connection elements 7 on the end portions 47 can also have slots 35 instead of bores 48. Alternatively or additionally, the suspension elements 10 on the end portions 46 and/or on the end portions 47 can have slots 35 instead of bores 48.

Figure 21:
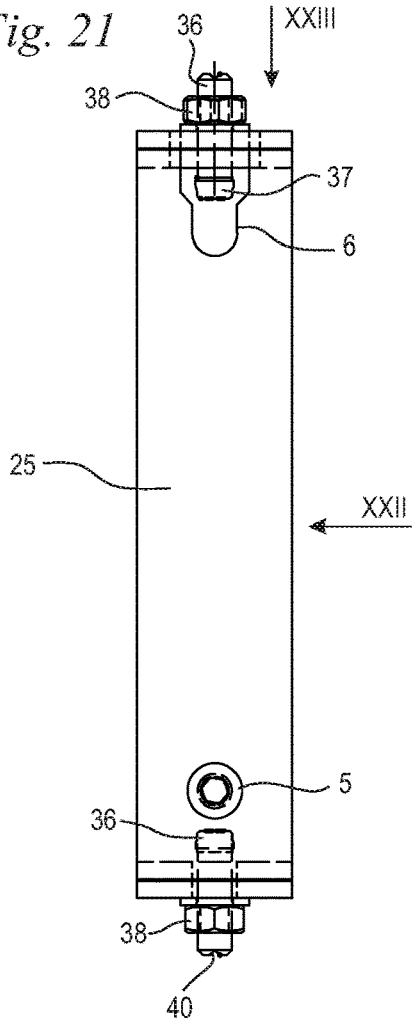
FIG. 21 shows a lateral view of the connection element from FIG. 20.
Figure 22:
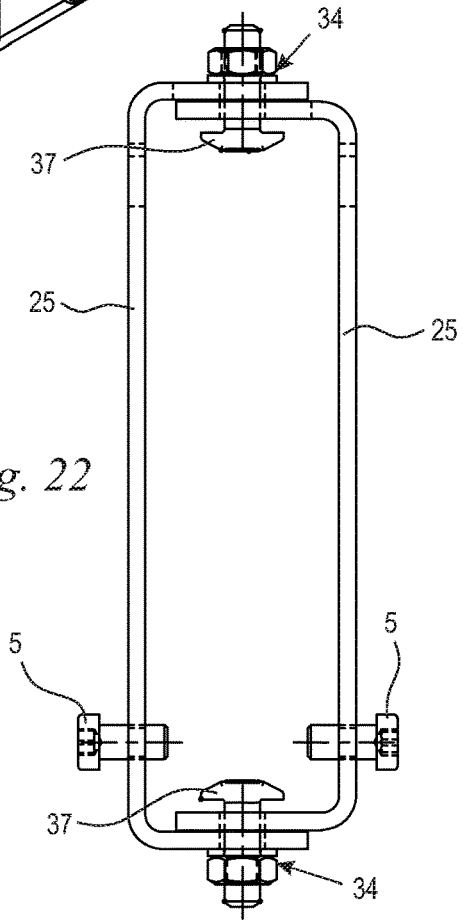
FIG. 22 shows a lateral view in the direction of the arrow XXII in FIG. 21 of the connection element from FIGS. 20 and 21.

As is shown in FIGS. 20 and 21, the screw 36 on the free end of the threaded portion thereof has a marking 40. The correct fit of the screw 36 after the assembly can be checked by way of the marking 40. If the hammer head 37 is aligned correctly so as to be perpendicular to the longitudinal direction of the longitudinal slot 26, the marking 40 also runs perpendicularly to the longitudinal slot 26.

All plug receptacles 6 in the exemplary embodiment run in the vertical direction. In one advantageous alternative design embodiment it is provided that the plug receptacles 6 run in the horizontal direction. On account thereof, further supports 2, 3 are not assembled in the vertical direction from above, but by lateral displacement or by lateral inward pivoting. A U-shaped disk which is pushed in from above and prevents any lateral displacement of the plug element 5 in the assigned plug receptacle 6 can serve as a securing element, for example.

Each connection element 7, 8, 9 in the exemplary embodiment supports a plug element 5 and a plug receptacle 6. The plug elements 5 and plug receptacles 6 are configured such that each second connection element 8 is selectively connectable to a first connection element 7 or 9, or to a further second connection element 8. In order for two second connection elements 8 to be interconnected, one of the connection elements 8 in relation to the other is disposed so as to be rotated by 180° about the longitudinal central axis 31 of the assigned support 2, 3, such that each plug element 5 comes to lie adjacent to a plug receptacle 6. All plug elements 5 are configured in an identical manner and embodied as screws which, by screwing in or unscrewing, permit an adjustment of the plug connections. All plug receptacles 6, with the exception of the length of the slot up to the terminal position of the plug element 5 in the connected state of the connection elements 7, 8, 9, are embodied in an identical manner. All connection elements 7, 8, 9 and the suspension element 10 are formed by connection brackets 22, 23, 24 and completely encompass the assigned longitudinal support 2 or transverse support 3. At least one connection installation 34 for connecting the two individual parts 25 of the connection brackets 22, 23, 24 simultaneously serves for fixing the position of the respective connection bracket 22, 23, 24 in the longitudinal direction of the assigned support 2, 3.

All connection brackets 22, 23, 24 are embodied as bent sheet-metal parts, only the plug elements 5 being screw-fitted thereinto and the connection installations 34 being disposed thereon in order for the connection elements 7, 8, 9 to be formed. A simple construction results on account thereof.

Only two or three, respectively, different types of connection elements 7, 8, 9 are required for a system of connection elements for connecting supports 2, 3. First connection elements 7 and second connection elements 8 are provided for the system shown in FIG. 1. First connection elements 9, suspension elements 10, as well as second connection elements 8 are required for the system shown in FIGS. 4 to 6. On account thereof, a modular system for connecting supports 2, 3 can be achieved in a simple manner.

While specific embodiments of the invention have been shown and described in detail to illustrate the inventive principles, it will be understood that the invention may be embodied otherwise without departing from such principles.

We claim:

1. A support system, comprising: supports; and connection elements for interconnecting the supports, wherein the supports are interconnected by plug connections, wherein interacting plug connection components that form the plug connection comprise at least one plug element and at least one plug receptacle, wherein each of the connection elements is fixed on a support and has at least one of the plug connection components, wherein the connection elements include first connection elements, the at least one plug connection component of the first connection elements being disposed on a longitudinal side of an assigned support, wherein the connection elements include second connection elements, the at least one plug connection component of the second connection elements being disposed on an end side of the assigned support, wherein the second connection elements are selectively connectable to a first connection element or to a further second connection element, wherein at least one of the connection elements has a connection bracket that encompasses the assigned support.

2. The support system according to claim 1, wherein each of the connection elements has at least one plug element and at least one plug receptacle, wherein when two connection elements are interconnected each plug element is disposed in an assigned plug receptacle.

3. The support system according to claim 1, wherein the plug element is a screw.

4. The support system according to claim 1, wherein the plug receptacle is configured as a clearance.

5. The support system according to claim 1, further comprising at least one plug-fittable securing element that secures the plug connection against unintentional release.

6. A support system, comprising: supports; and connection elements for interconnecting the supports, wherein the supports are interconnected by plug connections, wherein interacting plug connection components that form the plug connection comprise at least one plug element and at least one plug receptacle, wherein each of the connection elements is fixed on a support and has at least one of the plug connection components, wherein the connection elements include first connection elements, the at least one plug connection component of the first connection elements being disposed on a longitudinal side of an assigned support, wherein the connection elements include second connection elements, the at least one plug connection component of the second connection elements being disposed on an end side of the assigned support, wherein the second connection elements are selectively connectable to a first connection element or to a further second connection element, further comprising at least one suspension element separate from the connection elements and provided for connecting one of the supports to a support structure.

7. The support system according to claim 1, wherein at least one of the connection elements is provided for connecting one of the supports to a support structure.

8. The support system according to claim 1, wherein the connection bracket is formed by two individual parts that are interconnected on an upper side and a lower side of the support.

9. The support system according to claim 8, wherein the individual parts are C-shaped.

10. The support system according to claim 8, wherein the individual parts are interconnected by at least one connection installation that simultaneously fixes the connection element to the support.

11. The support system according to claim 8, wherein the individual parts are interconnected by at least one connection installation that simultaneously connects the connection element to a support structure.

12. The support system according to claim 1, wherein at least one of the connection elements has at least one lug for plug-fitting into one of the support at an end side.

13. The support system according to claim 1, wherein at least one of the connection elements is configured substantially as a bent sheet-metal part.

14. The support system according to claim 13, wherein all of the connection elements are configured substantially as bent sheet-metal parts.

15. The support system according to claim 1, wherein each of the plug connections, in an installed position, is assembled from above and produces a fixed connection in all horizontal directions and a downward fixed connection.

16. A system of connection elements for connecting supports by plug connections, wherein each of the connection elements has at least one plug connection component of a plug connection, wherein interacting plug connection components that form the plug connection comprise at least one plug element and at least one plug receptacle, wherein a first of the connection elements has a receptacle for passing through a support, wherein the at least one plug connection component of the first connection elements is disposed laterally to an longitudinal direction of the receptacle, and wherein a second of the connection elements has means for fastening the second connection element to an end side of a support, wherein the second connection element has at least one plug connection component disposed on a side of the second connection element that faces away from the means for fastening, and wherein the second connection elements are configured so that the second connection element is selectively connectable to one of the first connection elements or to a further second connection element.

* * * * *